US005368788A

United States Patent [19]

Boyesen

[11] Patent Number: 5,368,788

[45] Date of Patent: Nov. 29, 1994

[54] FLOAT BOWL FOR CARBURETORS

[76] Inventor: Eyvind Boyesen, R.D. #2, Box 246A, Kempton, Pa. 19529

[21] Appl. No.: 46,817

[22] Filed: Apr. 16, 1993

[51] Int. Cl.[5] ..... F02M 5/02

[52] U.S. Cl. ..... 261/44.3; 261/72.1; 261/DIG. 50

[58] Field of Search ..... 261/44.3, DIG. 50, 72.1

[56] References Cited

U.S. PATENT DOCUMENTS

| | | | |
|---|---|---|---|
| 1,422,329 | 7/1922 | Aseltine | 261/44.3 |
| 1,577,802 | 3/1926 | Johnson | 261/DIG. 50 |
| 3,338,565 | 8/1967 | Heid | 261/72.1 |
| 4,041,112 | 8/1977 | Nakamura et al. | 261/72.1 |
| 4,350,124 | 9/1982 | Kitano et al. | 261/DIG. 50 |
| 4,500,477 | 2/1985 | Zaita et al. | 261/DIG. 50 |
| 4,926,808 | 5/1990 | Kandler | 261/72.1 |
| 5,124,084 | 6/1992 | Eide | 261/72.1 |

FOREIGN PATENT DOCUMENTS

| | | | |
|---|---|---|---|
| 119429 | 8/1947 | Sweden | 261/44.3 |
| 223773 | 10/1924 | United Kingdom | 261/44.3 |

*Primary Examiner*—Tim Miles
*Attorney, Agent, or Firm*—John W. Logan, Jr.

[57] ABSTRACT

A carburetor float bowl is provided which is elongated in a direction lengthwise of the vehicle and has a smooth upwardly curved section on the bottom wall at the front and rear ends of the float bowl to minimize sloshing of the gasoline and also minimize foaming of the gasoline within the float bowl during severe back and forth rocking movement of the carburetor as would occur in a motorcycle passing over a series of bumps at a high speed.

7 Claims, 2 Drawing Sheets

FLOAT BOWL FOR CARBURETORS

BACKGROUND OF THE INVENTION

1. Field of the Invention

The present invention relates to new and useful improvements in carburetor float bowls, and more specifically to new and useful improvements in carburetor float bowls designed to prevent surges in fuel flow caused by severe vibrations.

2. Description of the Prior Art

It is extremely important, in carburetors, to maintain constant fuel level in the float bowl. If the gasoline level too high, an excess amount of fuel is drawn into the air-fuel mixture being fed to the engine, resulting in a greatly enriched fuel-air mixture which causes hesitation of the engine and a loss of power. In conventional carburetors, extreme continuous vibrations, such as riding a vehicle over a series of bumps, will cause the gasoline in the carburetor float bowl to foam. When the gasoline foams, the float will read the foam as an absence of gasoline and drop, thereby opening the gasoline intake valve causing more gasoline to enter the float bowl. The addition of excess gasoline to the float bowl will enrich the fuel-air mixture to a point where the power to the engine is decreased.

This phenonema is particularly apparent in off-the-road motorcycles when competing in Motocross racing. In such vehicles, passing over a series of bumps at high speeds will cause gasoline in the float bowl to foam and the floats in the float bowl to drop, thereby adding excess gasoline to the float bowl. This foaming is caused by constant bouncing of the motorcycle together with back and forth rocking movement which makes the gasoline slosh back and forth in the float bowl. To applicant's knowledge, this problem has not been previously addressed. Float bowls with extended dimensions widthwise of the vehicle have been provided with baffles to maintain a constant gasoline level in the float bowl when banking vehicles, particularly motorcycles, around a race track. However, foaming has been a long existing problem in off-the-road motorcycle racing and, to the present, has not been cured successfully.

With the foregoing in mind, an object of the present invention is to provide a carburetor float bowl which will prevent enriched fuel-air mixtures during extreme vibrations of a moving vehicle.

Another object of the present invention is to provide an improved carburetor float bowl which can be installed on existing carburetors and prevent enriched fuel-air mixtures due to extreme vibrations of the vehicle.

A still further object of the present invention is to provide a novel float bowl construction for carburetors which can be manufactured and installed easily and cheaply.

These and other objects of the present invention and the various features and details thereof are hereinafter more fully set forth and described with reference to the accompanying drawings and description.

SUMMARY OF THE INVENTION

A float bowl for any conventional carburetor is provided in which the dimension of the float bowl, in a direction transverse of the carburetor and longitudinally of the vehicle on which the carburetor is mounted, is substantially enlarged and the side walls of the float bowl at the enlarged sections are provided with a smooth upwardly directed curve to eliminate sloshing and foaming of the gasoline within the float bowl upon extreme vibrations of the carburetor.

DETAILED DESCRIPTION OF THE INVENTION

Figure 1:
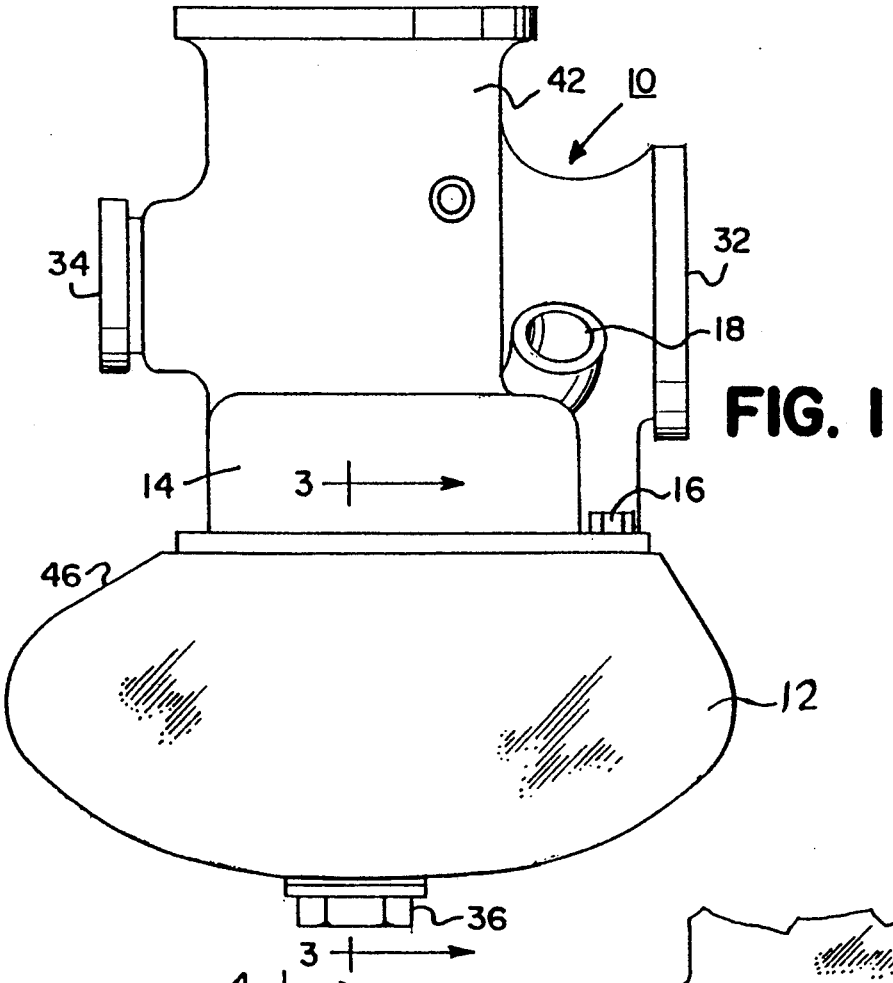
FIG. 1 is a side elevational view of a carburetor incorporating a float bowl of the present invention.
Figure 2:
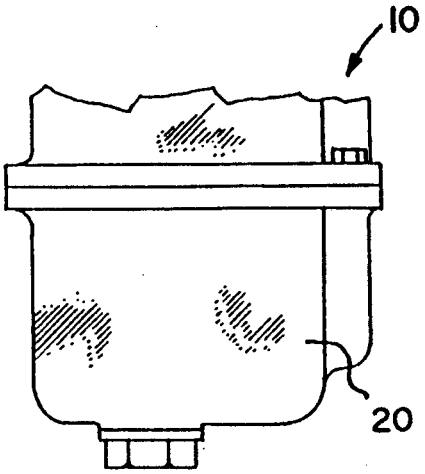
FIG. 2 is a fragmentary side elevational view of a carburetor utilizing a conventional float bowl.

Referring more specifically to the drawings, in FIG. 1 there is shown a side elevational view of a carburetor 10 incorporating a float bowl 12 of the present invention. The carburetor includes a housing 14 to which the float bowl is bolted, as at 16. A fuel inlet line, not shown, is connected to the carburetor at the fuel inlet 18 to supply fuel to the float bowl. FIG. 2 illustrates a fragmentary view of the same carburetor 10 connected with a conventional float bowl 20.

Figure 3:
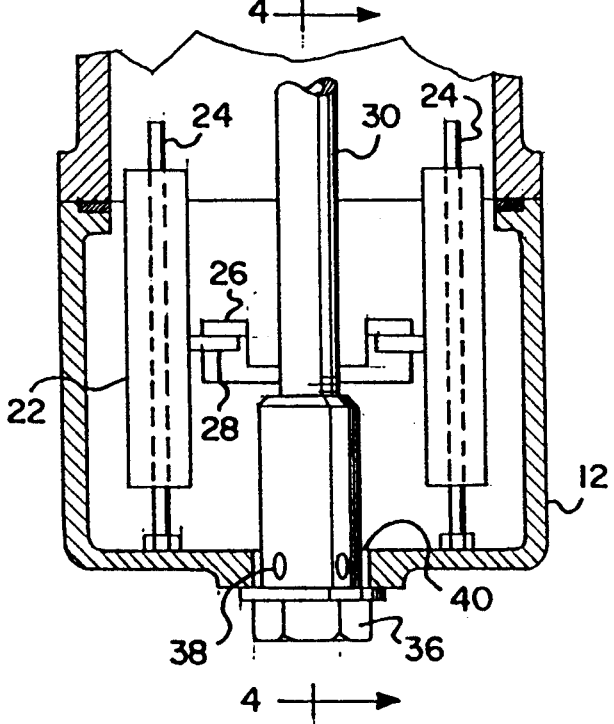
FIG. 3 is a sectional view taken along line 3—3 of FIG. 1.
Figure 4:
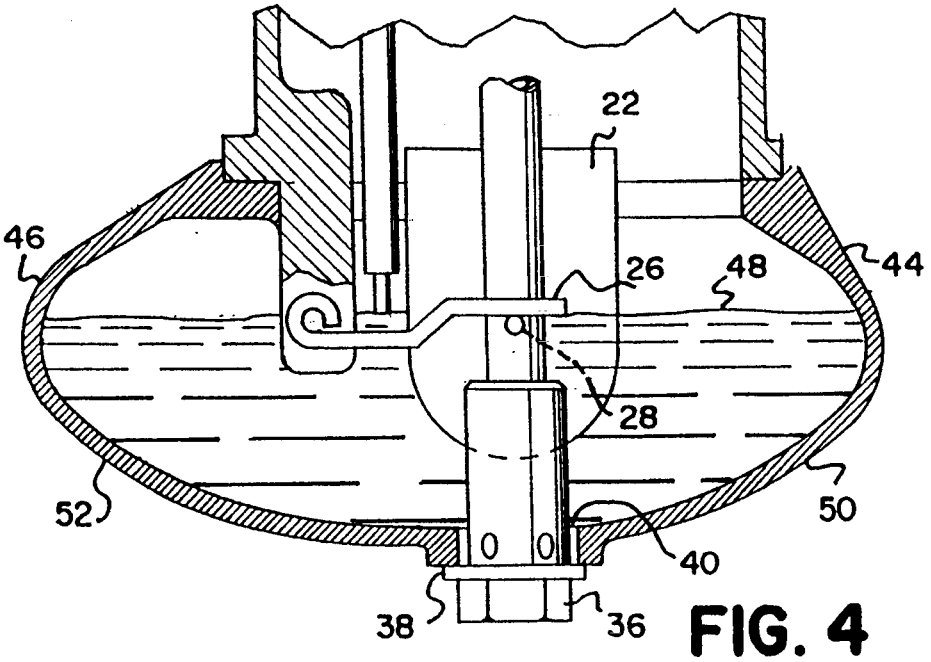
FIG. 4 is a sectional view taken along line 4—4 of FIG. 3.

With reference to FIGS. 3 and 4, floats 22,22 slidably mounted on guide rods 24,24 are positioned within the float bowl, floating on the fuel in the float bowl. These floats engage a valve actuating lever 26 by means of pins 28, 28 carried by each float. As the floats rise, for example, by additional fuel being added to the float bowl, the float pins force the valve actuating lever upward thereby closing a fuel valve, not shown, in the fuel supply passage to the float bowl. Also within the float bowl is the lower end of a fuel feed line 30 which feeds fuel to a venturi, not shown, at the air passage in the carburetor extending from the inlet side 32 to the fuel-air feed side 34 of the carburetor. A drain plug 36 having fuel inlet orifices 38 closes the drain opening 40 at the bottom of the float bowl and is threadedly engaged to the bottom end of the feed line 30. With this construction, when the engine is running, fuel is fed constantly from the float bowl to the venturi where it is mixed in the proper ratio with air and fed to the engine. As fuel is drawn from the float bowl, the floats drop downward and are followed by the valve supply lever opening the fuel supply valve permitting the fuel used to be replenished.

In the carburetor shown in the drawings, air flow controlled by a slide valve in the upper extension 42 of the carburetor body or housing 14. The carburetor construction, as described above is conventional, with the exception of the float bowl, and it should be understood that any conventional carburetor may be used with the float bowl 12 of the present invention. The carburetor 10 as shown, has a horizontal air passage from the inlet 32 to the outlet 34. The same float bowl may also be used with the down-draft type carburetor having a vertical air passage. In the down-draft type carburetor the float bowl will not be at the bottom of the housing, as shown in FIG. 1, but instead will be at the base of a housing extension on one side of the carburetor.

Figure 5:
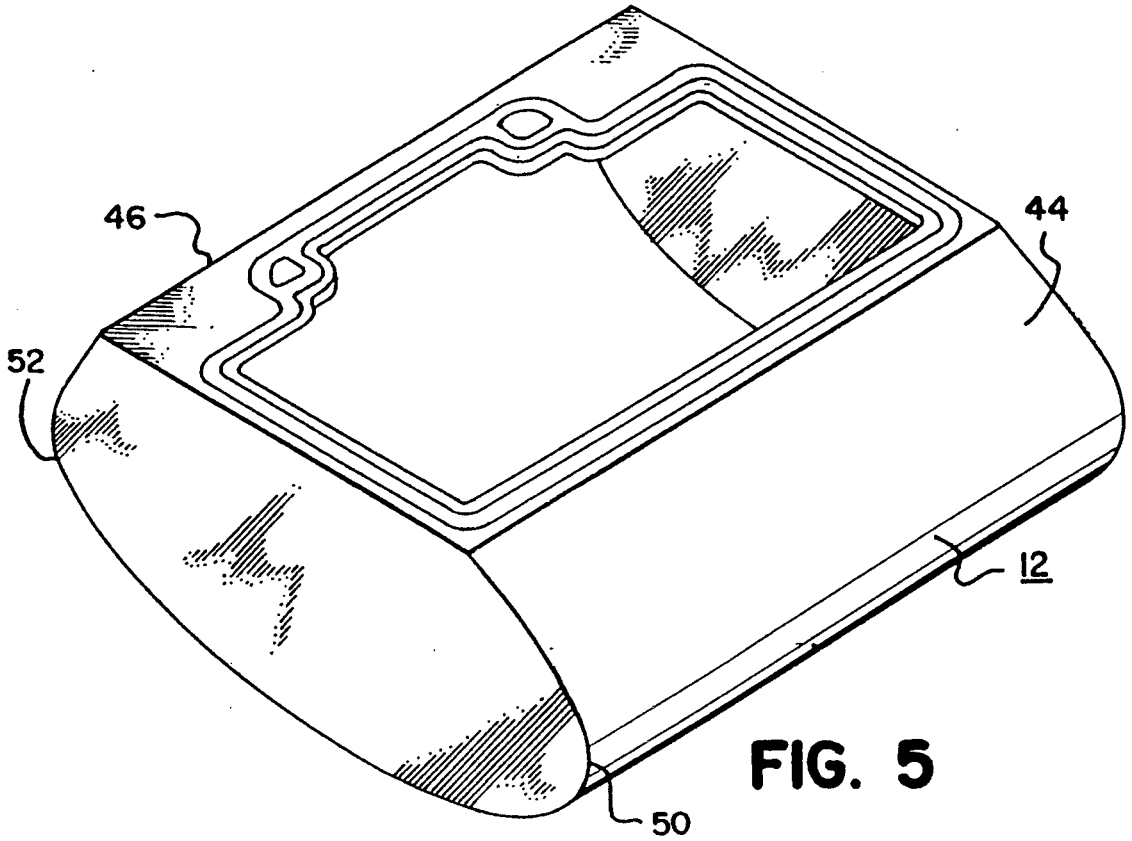
FIG. 5 is a perspective view of the float bowl of the present invention.

As shown in FIGS. 4 and 5 of the drawings, the float bowl extended beyond the walls of the carburetor body at both the front and rear of the carburetor, as indicated at 44 and 46, respectively in FIG. 4. This provides a greatly enlarged float bowl volume that when the fuel level is at the desired level, as indicated at 48, addition of excess fuel due to sloshing or foaming of the fuel in the float bowl results in a lesser increase in fuel level and thus lesser adverse affect on fuel flow. Additionally, the extended forward and rearward portions of the float bowl are curved gradually, as indicated at 50, 52. This curvature of the forward and rearward ends of the float bowl contributes greatly to minimizing or preventing foaming of the contained fuel during extreme rapid movement of the carburetor which occurs when the vehicle passes over closely spaced bumps. When a vehicle such as a motorcycle passes over closely spaced bumps, the vehicle pitches back and forth causing a back and forth rocking movement of the carburetor in a front-to-rear direction. The extended and gradually curved front and rear walls of the float bowl prevent abrupt change in direction of movement of the contained gasoline such as occurs under these conditions in conventional carburetor float bowls. This above described shape of the float bowl thereby eliminates problems of severe change in the fuel-air mixture being supplied to the engine passage of a vehicle such as a motorcycle over a series of bumps.

While a particular embodiment of the present invention has been illustrated and described herein, it is not intended to limit the invention to such a disclosure and changes and modifications may be incorporated and embodied therein within the scope of the following claims.

What is claimed is:

1. In a carburetor for a vehicle such as a motorcycle, said carburetor comprising a housing having a downwardly facing opening:

a float bowl secured to said housing over said downwardly facing opening;

said carburetor housing containing fuel supply means to supply fuel to said float bowl and float means extending through said downwardly facing opening into said float bowl to control flow of fuel through said fuel supply means;

said float bowl having a forward end and a rearward end relative to the longitudinal axis of the vehicle, said forward and rearward ends of the float bowl being extended beyond the downwardly facing opening of said carburetor housing;

said float bowl further including an upper wall, a bottom wall and opposite side walls, said bottom wall being curved upwardly at the forward and rearward ends of the float bowl and merging smoothly with said upper wall;

wherein said upper wall has an opening therein corresponding in size and shape to the downwardly facing opening of said carburetor housing, said upper wall being extended beyond said opening at the forward and rearward ends of said float bowl and joining with the upwardly curved forward and rearward ends of said bottom wall; and wherein said upper wall is inclined downwardly beyond said opening at the forward and rearward ends of said float bowl.

2. Apparatus in accordance with claim 1 wherein said bottom wall is of generally arcuate shape from the forward end to the rearward end of said float bowl.

3. Apparatus in accordance with claim 2 wherein said side walls are closely adjacent the opening in said upper wall and extend vertically downward to said bottom wall.

4. A float bowl for a carburetor, said float bowl comprising a casing having forward and rearward ends, upper and lower walls and opposite side walls;

an opening in said upper wall adapted to mate with a corresponding shaped opening in the carburetor;

said side walls extending vertically downward from said upper wall to said lower wall;

said upper wall projecting in opposite directions toward said forward and rearward ends of said float bowl beyond said opening and terminating in downwardly sloping end portions; and said lower wall terminating at said forward and rearward ends of said float bowl in upwardly curved end portions merging with the downwardly sloping end portions of said upper wall.

5. A float bowl in accordance with claim 4 wherein said lower wall is of generally arcuate shape from the forward to the rearward end of said float bowl.

6. A float bowl in accordance with claim 5 wherein said end portions of said upper wall are curved downwardly to merge smoothly with the upwardly curved end portions of said lower wall.

7. A float bowl in accordance with claim 6 wherein the merged end portions of said upper and lower walls form front and rear walls of said float bowl which are of generally arcuate shape.

* * * * *